US006182756B1

(12) United States Patent
Garcia et al.

(10) Patent No.: US 6,182,756 B1
(45) Date of Patent: Feb. 6, 2001

(54) METHOD AND APPARATUS FOR OPTIMIZING PRODUCTION FROM A GAS LIFT WELL

(75) Inventors: Gonzalo Garcia, Edo. Aragua; Aaron Ranson, San Antonio, both of (VE)

(73) Assignee: Intevep, S.A., Carcas (VE)

( * ) Notice: Under 35 U.S.C. 154(b), the term of this patent shall be extended for 0 days.

(21) Appl. No.: 09/248,374

(22) Filed: Feb. 10, 1999

(51) Int. Cl.[7] ..... E21B 47/00

(52) U.S. Cl. ..... 166/250.15; 166/372; 166/374; 166/72; 166/64; 166/321

(58) Field of Search ..... 166/64, 72, 91.1, 166/250.15, 321, 322, 372–374

(56) References Cited

U.S. PATENT DOCUMENTS

| | | | | |
|---|---|---|---|---|
| 4,267,885 | | 5/1981 | Sanderford . | |
| 4,442,710 | | 4/1984 | Meng . | |
| 4,738,313 | * | 4/1988 | McKee | 166/372 |
| 4,787,450 | | 11/1988 | Andersen et al. . | |
| 5,107,441 | * | 4/1992 | Decker | 364/510 |
| 5,172,717 | * | 12/1992 | Boyle et al. | 137/155 |
| 5,871,048 | | 2/1999 | Tokar et al. . | |
| 5,937,945 | * | 8/1999 | Bussear et al. | 166/250.15 |

FOREIGN PATENT DOCUMENTS 0756065 1/1997 (EP) .

* cited by examiner

*Primary Examiner*—Roger Schoeppel
(74) *Attorney, Agent, or Firm*—Bachman & LaPointe, P.C.

(57) ABSTRACT

A method for optimizing production from a gas lift well includes the steps of: obtaining a statistical model of production behavior of a gas lift well, the production behavior including known patterns of at least one production characteristic and corresponding operating parameters; operating the gas lift well at initial operating parameters; obtaining a real time value of the production characteristic from the gas lift well at the initial operating parameters; comparing the real time value of the production characteristic to the model to determine whether a known pattern is detected; and if a known pattern is detected, adjusting the operating parameters to the corresponding operating parameters. An apparatus is also provided.

15 Claims, 2 Drawing Sheets

METHOD AND APPARATUS FOR OPTIMIZING PRODUCTION FROM A GAS LIFT WELL

BACKGROUND OF THE INVENTION

The invention relates to a method and apparatus for improving production from an oil well, more specifically, for improving production from a gas lift oil well.

As is well known in the art, gas lift techniques are employed in oil wells which have difficulty in producing satisfactory levels of fluids based on natural formation pressure. Typically, such wells have formation pressure which is not sufficient to drive fluids at an acceptable volume to the surface.

The gas lift technique involves injecting gas into the casing of an oil well through one or more valves, typically located at varying heights along the well. Depending upon the technique being used, the gas may be injected substantially continuously into the column of fluid in the well, thereby lightening this column of fluid so as to enhance the volume of production which can be accomplished with natural formation pressure. Alternatively, gas can be injected intermittently in a repeated or cyclical process so as to produce successive slugs of fluid at the well head.

Although gas lift techniques provide excellent results for certain types of oil wells, each well is different in terms of downhole or formation pressure, downhole or formation temperature, depth to the producing formation, geothermal gradient experienced along the vertical height of the well, and numerous other factors. Thus, determining the optimal operating parameters for a gas lift technique is a time consuming trial and error process which may require extensive supervision and nevertheless provide less than ideal production.

U.S. Pat. No. 4,267,885 to Sanderford is drawn to a method for optimizing production in a continuous or intermittent gas lift well which, through trial and error, increases and/or decreases the volume of gas injected while monitoring the temperature of fluids produced at the surface. According to this method, gas injection is increased and/or decreased as desired so as to provide a maximum possible fluid temperature at the surface. For intermittent production, a similar method is disclosed where the volume of production is monitored per gas injection cycle in an attempt to determine the gas injection volume which will provide maximum possible fluid temperature at the surface. In both cases, a continuous trial and error method is used changing gas injection volumes and waiting to see the effect of such change at the surface. Thus, Sanderford '885 is a trial and error method, and possesses the expected disadvantages for such a method.

In light of the foregoing, it is evident that the need remains for an advantageous method and apparatus for enhancing production from a gas lift well.

It is therefore the primary object of the present invention to provide a method for optimizing production from a gas lift well.

It is a further object of the present invention to provide an apparatus for optimizing production from a gas lift well.

It is a still further object of the present invention to provide a method and apparatus which is readily adaptive to the widely varying conditions experienced at different gas lift wells.

It is another object of the present to provide a method and apparatus which learns well behavior for the specific conditions of a particular well and which controls gas injection and production from the well based upon pattern recognition and past well behavior so as to significantly reduce and/or completely avoid the need for extended or continuous trial and error operation.

Other objects and advantages of the present invention will appear hereinbelow.

SUMMARY OF THE INVENTION

In accordance with the present invention, the foregoing objects and advantages have been readily attained.

According to the invention, a method is provided for optimizing production from a gas lift well, which method comprises the steps of obtaining a statistical model of production behavior of a gas lift well, said production behavior including known patterns of at least one production characteristic and corresponding operating parameters; operating said gas lift well at initial operating parameters; obtaining a real time value of said production characteristic from said gas lift well at said initial operating parameters; comparing said real time value of said production characteristic to said model to determine whether a known pattern is detected; and if a known pattern is detected, adjusting said operating parameters to said corresponding operating parameters.

In further accordance with the present invention, an apparatus has been provided for optimizing production from a gas lift well, which apparatus comprises means for storing a statistical model of production behavior including at least one production characteristic and corresponding operating parameters; means for obtaining real time value of said production characteristic from said gas lift well at initial operating parameters; means, associated with said means for storing and said means for obtaining, for comparing said real time value of said production characteristic to said model to determine whether a known pattern is detected; and means for adjusting said operating parameters to said corresponding operating parameters when a known pattern is detected.

BRIEF DESCRIPTION OF THE DRAWINGS

A detailed description of preferred embodiments of the present invention follows, with reference to the attached drawings, wherein.

DETAILED DESCRIPTION

The invention relates to a method and apparatus for optimizing production from a gas lift well, more particularly, for optimizing oil production from an oil well which is being produced using continuous or intermittent gas lift techniques. Advantageously, the method and apparatus of the present invention operate by constructing a statistical model of well behavior for a well based on gathered real time data from that well which is then used in accordance with the present invention to dictate optimized operating parameters geared specifically to that well for optimizing and/or totally eliminating the need for continuous trial and error operation for the well.

Figure 1:
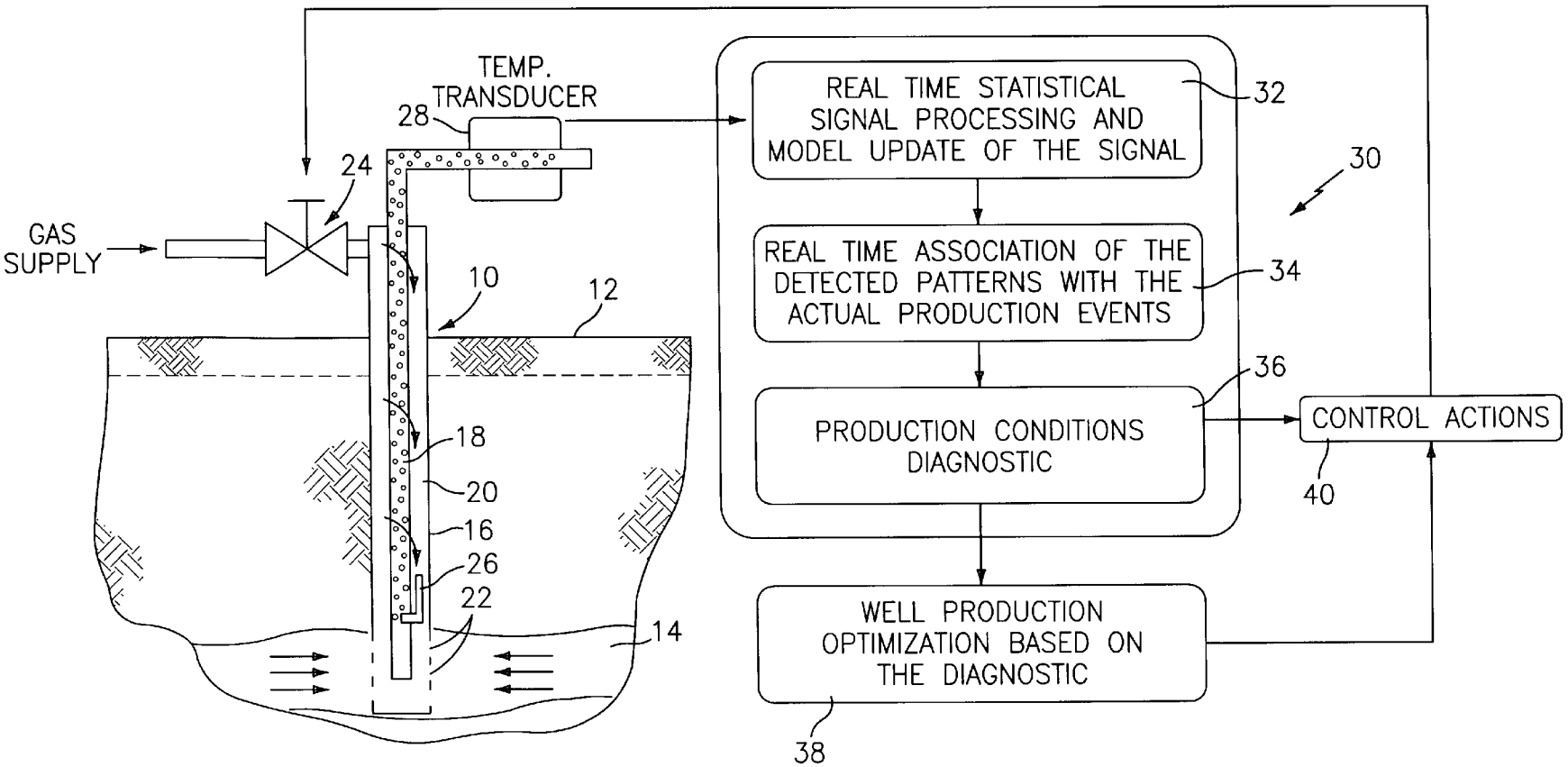
FIG. 1 schematically illustrates a method and apparatus in accordance with the present invention.

FIG. 1 schematically illustrates a typical gas lift injection environment including a well 10 drilled from the surface 12 to a producing formation 14 and having a casing 16, a production tube 18, and an annular space 20 defined between casing 16 and production tube 18. As shown, casing 16 is typically perforated at perforations 22 to allow desirable fluids to enter annular space 20 and production tube 18. As shown, in a typical gas lift well, gas is fed through one or more valves schematically represented at 24 to annular space 20, and enters the inner space of production tube 18, for example through one or more mandrels 26. In a continuous gas injection technique, this gas injection serves to lighten the density of fluid inside production tube 18 so that this fluid can more easily be produced by natural formation pressure and/or pumping. In an intermittent gas lift technique, gas is injected into annular space 20 on an intermittent basis, allowing time to elapse between injections so that sufficient fluid can accumulate within production tube 18, and each gas injection is used to drive a slug of such accumulated fluid to the surface.

In accordance with the present invention, a temperature transducer 28 is associated with fluid produced at the surface to obtain real time temperature measurements of the produced fluid. This information is fed to a processor 30 which uses the information to generate a statistical model of production behavior of the well. This model is based upon the real time temperature measurements obtained, and could if desired be based upon or include further production data such as flow pattern and/or gas/water/crude ratios. The model or database also includes stored operating parameters corresponding to particular patterns of the statistical model such as produced fluid surface temperature patterns, which after sufficient installation and diagnostic operation, will be called upon for controlling production from the well according to the invention.

Upon initial installation of processor 30 at one or more wells 10, processor 30 is operated in an installation mode, preferably for a period of at least about thirty minutes, so as to gather sufficient data to generate the statistical model as desired in accordance with the present invention. Processor 30 may for example be installed as a part or element of a supervisory control and data acquisition system to be associated with one or more wells in production. Through temperature transducer 28, processor 30 receives real time temperature information as soon as it is available, and each sampled temperature received is immediately used to update the statistical model. In this way, the statistical model is generated based on behavior and operating parameters of the actual well to be controlled, and the model therefore has a high degree of accuracy.

During the installation phase, most parameters related to the model are self-adjusted, preferably by processor 30, so that a sufficient model including relevant production characteristics can be made. Some parameters, such as response time or action-reaction interval, can be adjusted or entered manually or determined by processor 30 prior to the installation stage. This parameter represents the time necessary for a specific action taken to be reflected in the temperature of fluids at the well head.

After sufficient construction of the statistical model through operation in the installation mode, processor 30 is then operated in a diagnostic mode. In this mode, real time temperature measurements are monitored so as to compare actual production behavior, for example a series of temperature measurements, with the statistical model. This comparison is carried out in an effort to detect a pattern match of a series of received temperature measurements with a series of values in the statistical model. If a known pattern is detected, then control actions for modifying one or more operating parameters are issued by processor 30, for example commands to valves 24 for modifying gas injection. Such commands would be intended to optimize production of the well based upon past performance as represented by the statistical model. As will be discussed below, these commands are validated in the diagnostic mode. After sufficient diagnostic operation, processor 30 is then ready for use in operating the well.

Certain patterns might also be indicative of problems. For example, actual measurements could include anomalies indicative of undesirable gas recycling, and the statistical model can recognize such anomalies as they match past behavior and issue commands for corrective action.

If no pattern is recognized, processor 30 prompts an operator to enter appropriate control actions, and the non-recognized pattern along with entered control actions are then added to the statistical model so that the model is expanded to recognize and, if necessary, act on additional behavior patterns of the well. In this way the system of the present invention becomes capable of better control of a gas injection process as the process continues.

FIG. 1 further illustrates operation of the invention. Processor 30 carries out a series of steps including step 32 wherein real time statistical signal processing is carried out and a statistical model is created or updated, step 34 wherein real time values in the model are associated with actual production events and/or operating parameters so as to complete the initial model, step 36 wherein real time values or patterns of values are compared to the statistical model to determine whether a pattern match exists and, if a match is detected, step 38 wherein control actions for optimizing production are issued to gas injection valves 24, and if no pattern match is detected, step 40 wherein an operator is prompted to manually enter control actions. In step 40, the additional control actions entered by an operator may be actions to correct potential problems rather than actions to optimize production. In any event, the action taken by the operator is stored in the database and associated with the model for subsequent use, if necessary, under the same conditions.

Figure 2:
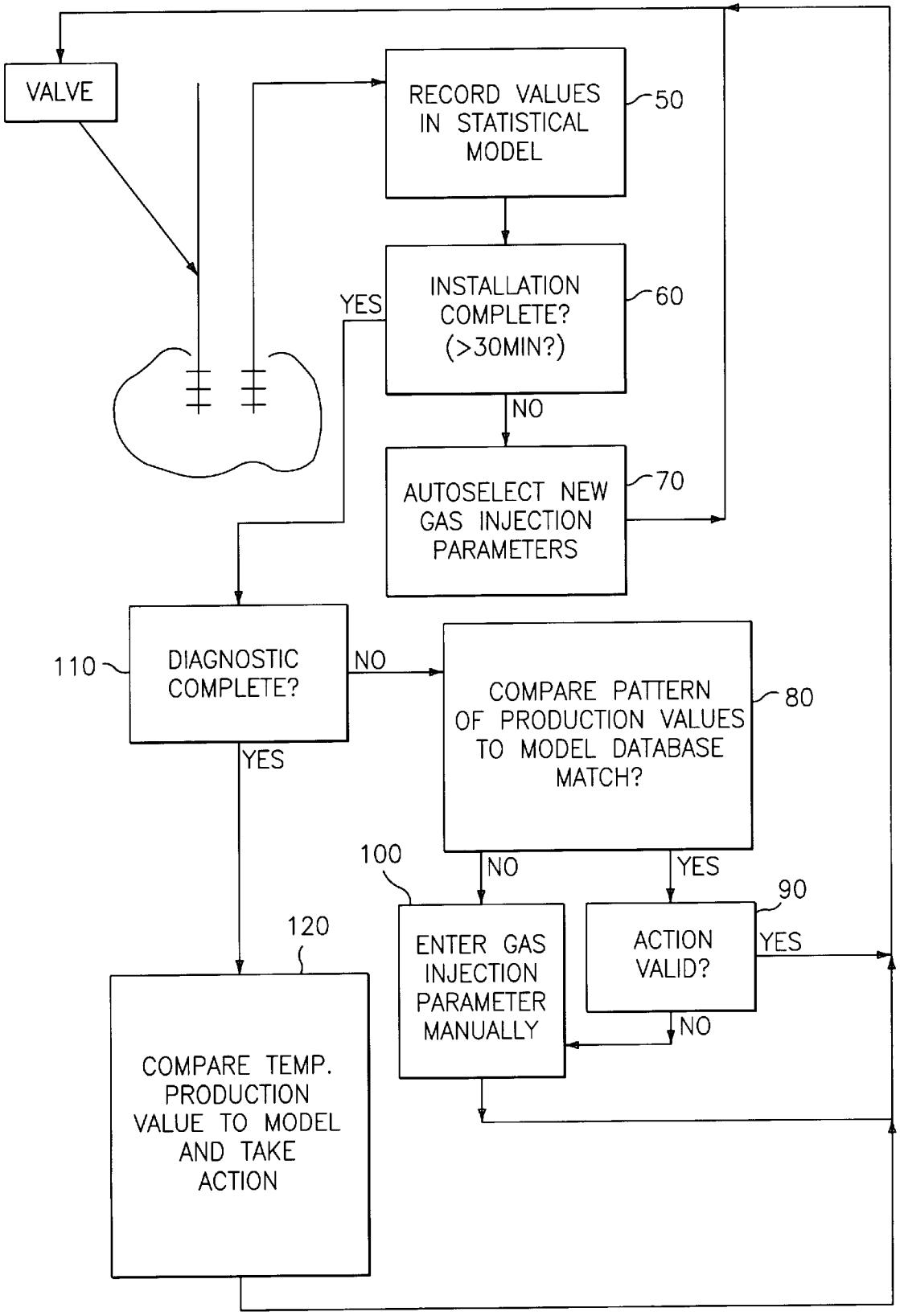
FIG. 2 is a schematic illustration of the installation, diagnostic and operating phases of the present invention.

Referring now to FIG. 2, a flowchart is presented schematically illustrating the operation of the method and apparatus of the present invention during the installation, diagnostic and operation phases or stages.

During the installation stage, processor 30 auto-selects gas injection parameters at which the well is operated, and production characteristics are recorded in the statistical model. This is carried out, preferably for at least about 30 minutes, so as to provide the base of a statistical model reflecting well performance at various auto-selected gas injection parameters. This installation phase is represented by steps 50, 60 and 70 in FIG. 3.

Following installation, the method and apparatus of the present invention are operated in a diagnostic phase wherein specific gas injection parameters corresponding to certain production patterns are manually entered and/or validated so as to finish preparation of the statistical model for use in optimizing production from the well. During this stage, specific patterns of well performance may be detected which indicate anomalies such as undesirable gas recycling, and appropriate corrective actions can be manually entered and validated so as to be incorporated into the statistical model. The diagnostic stage of the method of the present invention is represented by steps 80, 90, 100 and 110 in FIG. 2.

Following installation and diagnostic stages, the method and apparatus of the present invention are ready for use in controlling production from one or more wells. This operation is indicated by step 120 in FIG. 2.

In accordance with the present invention, the control actions or operating parameters which can be issued by processor 30 include gas injection parameters such as gas flow rate and time or duration of injection, possible changes in the injection point along the well height, on-off of gas injection to a particular well, and the like. The "on-off" parameter relates to the status of gas injection to a particular well, and could be used to switch to another well to control or optimize. There are also situations where a well will by itself encounter an on-off condition. For example, an on-off condition could be triggered by a gas injection flow rate to a well which is too high and triggers a safety system to an off condition.

The method and apparatus in accordance with the present invention operate as indicated above and, after completion of a cycle, the method is either carried out on a new well, or is carried out on the next cycle of operation of the present well. In this manner, it should be readily appreciated that the method and apparatus of the present invention can be used to optimize production from a series of wells.

The method and apparatus of the present invention is adaptive and iterative, and advantageously provides for optimization of operating parameters of a gas lift well based upon pattern recognition of past performance of the well, thereby significantly reducing the need to rely on trial and error for well operation

We claim:

1. A method for optimizing production from a gas lift well, comprising the steps of:

obtaining a statistical model of production behavior of a gas lift well, said production behavior including known patterns of at least one production characteristic and corresponding operating parameters;

operating said gas lift well at initial operating parameters;

obtaining a real time value of at least one of said at least one production characteristic from said gas lift well at said initial operating parameters;

comparing said real time value to said model to determine whether said known patterns include a matching pattern matching said real time value; and when said matching pattern is detected, adjusting said initial operating parameters to operating parameters from said model corresponding to said matching pattern.

2. A method according to claim 1, wherein said at least one production characteristic is selected from the group consisting of temperature of produced fluid, volume of produced fluid, gas-oil ratio of produced fluid and combinations thereof.

3. A method according to claim 1, wherein said at least one production characteristic comprises temperature of produced fluid.

4. A method according to claim 1, wherein said initial and corresponding operating parameters are selected from the group consisting of gas injection rate, gas injection location, duration of gas injection and combinations thereof.

5. A method according to claim 1, wherein said step of obtaining said statistical model comprises the steps of operating said gas-lift well at said initial operating parameters and recording corresponding values of said at least one production characteristic so as to provide said statistical model.

6. A method according to claim 5, wherein said obtaining step further comprises periodically selecting new values of said operating parameters so as to generate patterns of said values of said operating parameters and said corresponding values of said at least one production characteristic.

7. A method according to claim 1, wherein said step of obtaining a real time value comprises obtaining a series of real time values, and said comparing step comprises comparing said series to said model to determine whether said known patterns include a matching pattern matching said series.

8. A method according to claim 7, wherein said series of real time values comprises a time-oriented sequence of more than two values of said at least one production characteristic.

9. A method according to claim 1, further comprising the step of, if a known pattern is not detected in said comparing step for a particular pattern of real time values of said production characteristic, requesting input of additional corresponding operating parameters for said particular pattern of real time values, and adding said particular pattern of real time values and said additional corresponding operating parameters to said statistical model.

10. A method for optimizing production from a gas lift well, comprising the steps of:

obtaining a statistical model of production behavior of a gas lift well, said production behavior including known patterns of temperature of produced fluid and corresponding operating parameters;

operating said gas lift well at initial operating parameters;

obtaining a real time value of said temperature from said gas lift well at said initial operating parameters;

comparing said real time value to said model to determine whether said known patterns include a matching pattern matching said real time value; and when said matching pattern is detected, adjusting said initial operating parameters to operating parameters corresponding to said matching patterns.

11. A method according to claim 10, wherein said initial and corresponding operating parameters are selected from the group consisting of gas injection rate, gas injection location, duration of gas injection and combinations thereof.

12. An apparatus for optimizing production from a gas lift well, comprising:

means for storing a statistical model of production behavior including known patterns of at least one production characteristic and corresponding operating parameters;

means for obtaining a real time value of said production characteristic from said gas lift well at initial operating parameters;

means associated with said means for storing and said means for obtaining, for comparing said real time value of said production characteristic to said model to determine whether said known patterns include a matching pattern matching said real time value; and means for adjusting said initial operating parameters to operating parameters corresponding to said matching pattern when said matching pattern is detected.

13. An apparatus according to claim 12, wherein said statistical model contains said at least one production characteristic and said corresponding operating parameters obtained from at least about 30 minutes of well operation.

14. An apparatus according to claim 12, wherein said known patterns comprise stored time-oriented patterns of said at least one production characteristic.

15. An apparatus according to claim 14, wherein said means for obtaining said real time value comprises means for obtaining a time-oriented series of more than two values of said at least one production characteristic.

* * * * *